US007367798B2

(12) United States Patent
Sarv

(10) Patent No.: US 7,367,798 B2
(45) Date of Patent: May 6, 2008

(54) TUNNELED MULTI-SWIRLER FOR LIQUID FUEL ATOMIZATION

(76) Inventor: Hamid Sarv, 2958 Mill Ridge Cir., NW., Canton, OH (US) 44708

( * ) Notice: Subject to any disclaimer, the term of this patent is extended or adjusted under 35 U.S.C. 154(b) by 392 days.

(21) Appl. No.: 11/100,731

(22) Filed: Jun. 8, 2005

(65) Prior Publication Data

US 2006/0281036 A1 Dec. 14, 2006

(51) Int. Cl.
*F23M 9/00* (2006.01)

(52) U.S. Cl. ..... 431/185; 431/183; 431/284; 431/351; 431/9

(58) Field of Classification Search ..... 431/185, 431/183, 181, 284, 351, 8, 9, 10; 239/403, 239/404, 405, 406
See application file for complete search history.

(56) References Cited

U.S. PATENT DOCUMENTS 5,470,224 A * 11/1995 Bortz ..... 431/182
6,152,054 A * 11/2000 Ashworth et al. ..... 110/345

* cited by examiner

*Primary Examiner*—Alfred Basichas
(74) *Attorney, Agent, or Firm*—Eric Marich; Michael J. Seymour

(57) ABSTRACT

An air swirler capable of liquid fuel atomization for a fuel fired burner in a furnace or boiler having a hollow guide pipe supporting several swirl blades at an end adjacent to the furnace. Openings connected by tunnels to the inside of the guide pipe are provided in the trailing edges of each swirl blade. A fuel pipe is concentric with the guide pipe forming an annular space therebetween. Gaseous substances such as oxygen or natural gas are provided through the annular space and liquid fuel is provided through the fuel pipe. The fuel and gaseous substances travel through the tunnels to the openings for liquid fuel atomization and pre-mixing at the burner throat to reduce $NO_x$ formation.

7 Claims, 4 Drawing Sheets

TUNNELED MULTI-SWIRLER FOR LIQUID FUEL ATOMIZATION

FIELD AND BACKGROUND OF INVENTION

The present invention relates generally to the field of industrial furnace and boiler fossil fuel burners and in particular to a new and useful burner swirler with openings in the trailing edge of the swirler blades for liquid fuel atomization and injection into the combustion mix.

Conventional fuel oil atomizers consist of a single centerline pipe or barrel through which a liquid fuel and atomizing substance (typically steam) flow concentrically toward a mixing chamber and subsequently to a multi-hole sprayer cap. Holes are drilled in the sprayer cap to create a radially diverging spray pattern in the shape of a cone. Atomizers are generally positioned in the center of burners where swirling combustion air is provided for burning the liquid fuel. In some cases, a bladed swirler is also installed adjacent to the sprayer cap to mix the combustion air with the fuel spray.

Oxygen-enriched combustion and full substitution of air with oxygen have gained considerable attention for their demonstrated low emissions and high combustion efficiency improvements over the air-blown operation. Oxygen can be introduced into the combustion zone in several ways.

In a multi-annulus burner, oxygen can be introduced by premixing it with combustion air, recirculated fuel gas, overfire air, or by direct injection via lances.

In an oil-fired burner, oxygen can also be used as the atomizing medium in the fuel atomizer instead of steam or compressed air.

Burning fossil fuels generates $NO_x$ from the oxidation of fuel-nitrogen content and/or direct oxidation of atmospheric nitrogen in the combustion air. $NO_x$ is a known precursor to acid rain, photochemical smog and air pollution in general. Various methods have been formulated to reduce $NO_x$ emissions. One such $NO_x$ reduction method involves the use of natural gas in fossil fuel burners.

As taught by U.S. Pat. No. 5,807,094, an air-premixed natural gas burner is provided which has reduced $NO_x$ formation resulting from partial pre-mixing of air and natural gas adjacent to the burner throat. The entire disclosure of U.S. Pat. No. 5,807,094 is incorporated herein by reference.

U.S. Pat. No. 5,470,224 discloses a burner having natural gas injected between the blades of an air swirler for rapid mixing.

U.S. Pat. No. 5,829,369 describes the use of axial natural gas elements for co-firing fuel gas with pulverized coal.

In fossil fuel-burning boilers, fuel and air enter into the furnace to mix and burn. Low-$NO_x$ burners operate on the principle of controlled separation and mixing of the fuel and oxidizer. Internally staged burners minimize the early mixing between oxygen-rich air and fuel streams during fuel pyrolysis, so that the nitrogenous compounds in the fuel convert to $N_2$ rather than $NO_x$. Externally staged burners operate with even less oxidizer in the main combustion zone to minimize $NO_x$ formation since part of the total oxidizer is diverted and re-introduced into the furnace downstream of the burner zone through the overfire (OFA) ports.

Fuel reburning is also used for $NO_x$ reduction (up to 30% fuel reburn). It involves injecting a supplementary fuel (e.g., natural gas, fuel oil, or pulverized coal) with air above the generally oxygen-rich (stoichiometric ratio, $SR \geqq 1.0$) main flame zone to create a locally oxygen-deficient reburn zone ($SR<1.0$). In the reburn zone, the supplementary fuel generates hydrocarbon radicals, amines, and cyanic species that react with the incoming main combustion zone products to convert $NO_x$ to $N_2$. Additional air is introduced through the OFA ports above the reburn zone to complete the burning of the combustible matter. In some applications, a part of the flue gas from downstream of the boiler exit is re-circulated into the reburn burner. Flue gas re-circulation (FGR) provides a means for transporting the reburn fuel into the furnace. It also helps to reduce $NO_x$ by quenching the local reaction zone.

SUMMARY OF INVENTION

It is an object of this invention to provide a unique way to improve the dispersion, mixing, and burning of liquid fuel sprays relative to conventional commercial atomizers by accomplishing the fuel atomization with compressed oxygen gas or another atomizing medium in a tunneled and bladed swirler.

It is a further object of the present invention to provide an apparatus for use in industrial burners that further reduces $NO_x$ emissions generated from the combustion of fossil fuels.

It is yet a further object of the invention to provide a swirler having an injection mechanism for providing oxygen or natural gas to a combustion zone to reduce $NO_x$ formation.

Another object of the invention is to provide a swirler for use with oil-burning burners or a low $NO_x$ burner or a reburn fuel air burner.

Accordingly, a swirler with an elongated hollow guide pipe supporting multiple blades adjacent to a furnace end is provided. The swirler blades each include tunnels, in communication between the inside of the guide pipe and openings in the swirler blade trailing edges facing the furnace combustion chamber. The swirler includes a guide pipe having an inner concentric fuel pipe. An annular space is formed between the inner surface of the guide pipe and the outer surface of the fuel pipe. The annular space transports gaseous substances, such as oxygen, natural gas or other gaseous combustion substances, to the tunnels in the swirler blades. The inner fuel pipe transports the fuel to the tunnels of the swirler blades. The tunnels, in turn, transport the fuel and gaseous substance to the openings.

The particular orientations, size, cross-sectional shape, and number of openings in each blade edge can be varied depending on the desired application, including for affecting stoichiometry, supply pressure, injection velocity, and overall burner design.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 2:
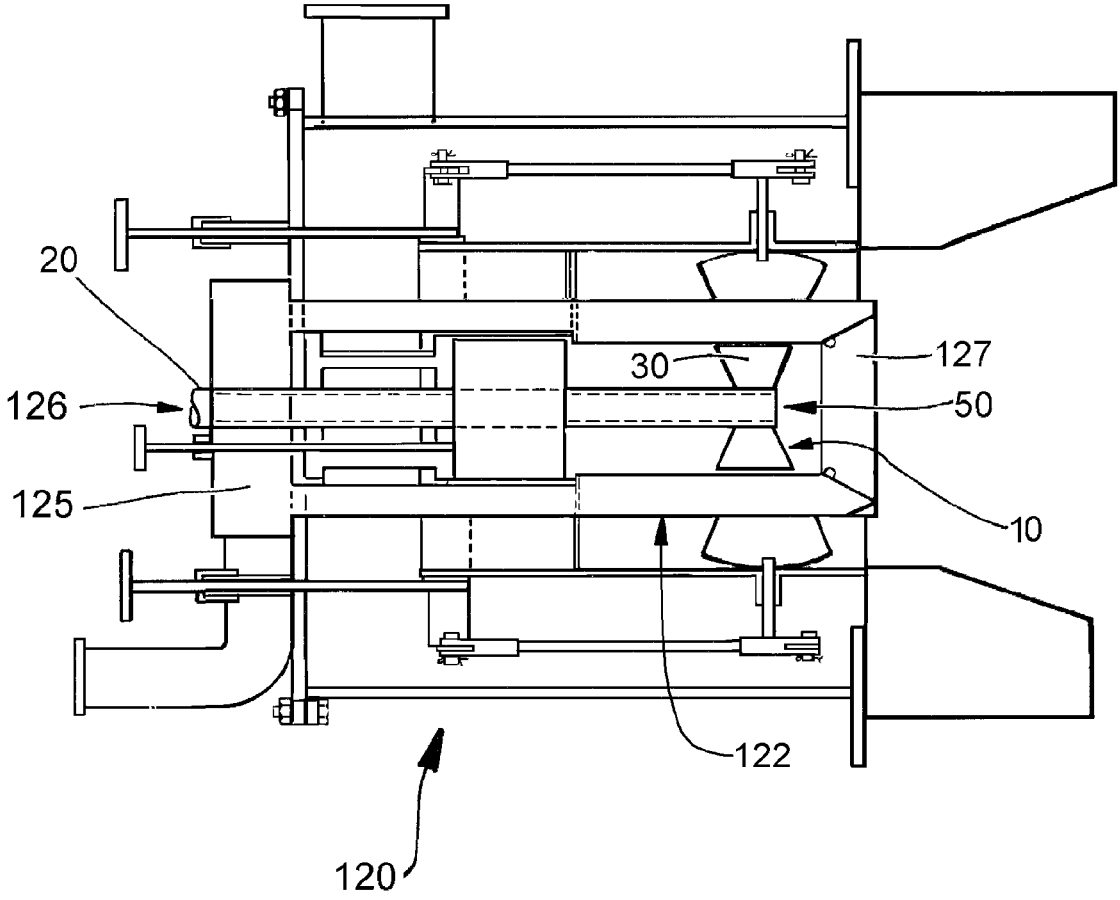
FIG. 2 is a side elevational view of a fuel oil burner employing the swirler of the invention.

Referring now to the drawings, in which like reference numerals are used to refer to the same or similar elements, FIG. 2 shows a swirler 10 used in a fuel fired burner 120. The fuel fired burner 120 has a burner barrel 122 having a supply end 126 and a burner throat opening 127 at an opposite end.

The swirler 10 has a hollow guide pipe 20 which supports several swirl blades 30 adjacent to the burner throat opening 127. Swirler 10 is of a type known for use in furnace burners to improve the air mixing adjacent the burner throat. Furnace end 50 of swirler 10 is typically positioned very close to the burner throat opening 127 into the associated furnace and is oriented facing the furnace combustion region. Swirler 10 may also be positioned facing the reburn zone of the furnace for fuel oil reburning with oxygen.

The swirler 10 is preferably installed concentric with the burner barrel 122 to impart a swirling effect and create a central reverse flow zone to circulate heat and combustion products including $NO_x$ back to the flame root. This action sustains ignition and further reduces $NO_x$ emissions.

Figure 1:
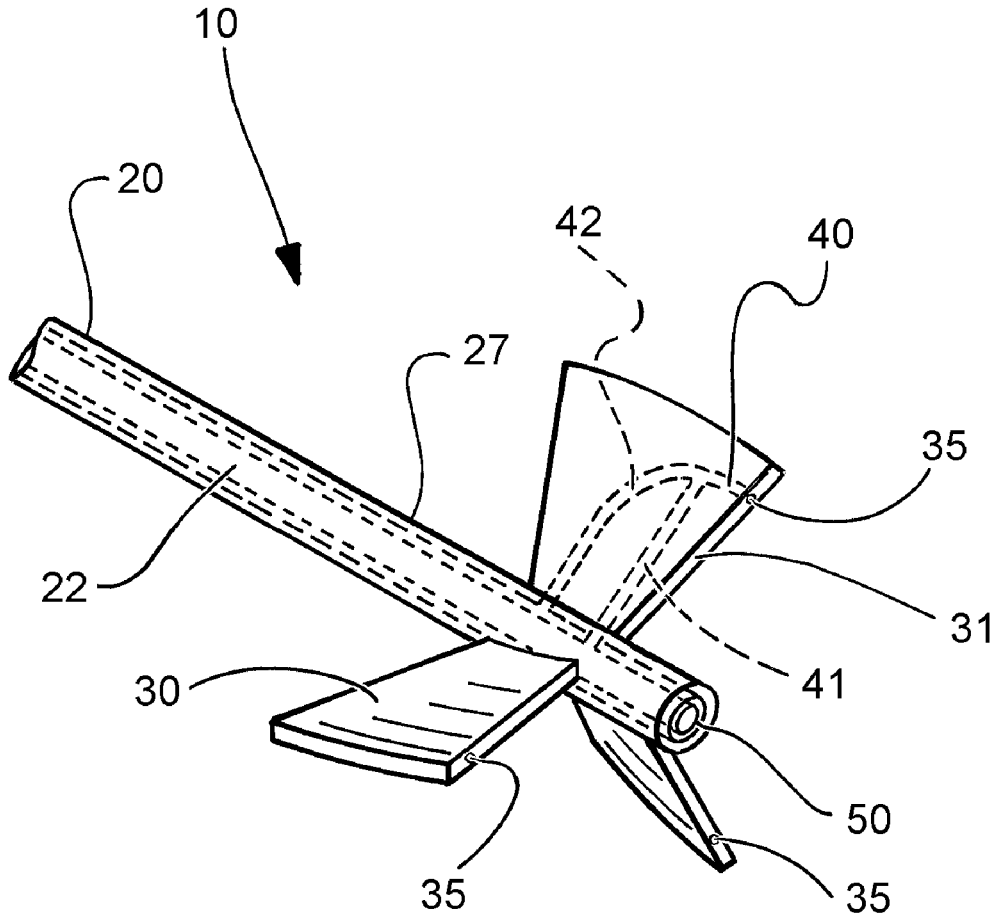
FIG. 1 is a perspective view of a swirler according to the invention.

As shown in FIG. 1, the swirler 10 has an outer guide pipe 20 surrounding an inner fuel supply pipe 22. An annular space 27 is formed between the guide pipe 20 and inner fuel supply pipe 22. Inner fuel supply pipe 22 is used to carry fuel to the swirl blade 30. Natural gas, oxygen or another suitable gaseous substance, such as steam or compressed air, can be supplied through the annular space 27 to swirl blades 30.

The swirl blades 30 are fixedly mounted to the outside of guide pipe 20 in a known manner and orientation, which can be varied depending on the application of the swirler 10.

Each swirl blade 30 includes a series of openings 35 in the trailing edges 31 adjacent the furnace end 50 of the guide pipe 20. The openings 35 are fluidly connected to the guide pipe 20 by channel 40 and tunnels 41, 42 within the body of the swirl blade 30.

The openings 35 connect via channel 40 to the tunnels 41, 42. The channel has an inlet where the tunnels 41, 42 merge and an outlet formed at the openings 35.

Tunnel 41 transports fuel from the inner fuel supply pipe 22 of the guide pipe 20 to the channel 40.

Tunnel 42 transports the gaseous substance or atomizing medium from the annular space 27 to the channel 40.

In the inlet end of channel 40 where tunnels 41 and 42 merge, the high velocity stream of the gaseous substance shears and disintegrates the fuel stream into spray droplets that are delivered to the combustion zone via openings 35.

The size, shape, and number of blades 30 and openings 35, as well as the injection angle and blade orientation can vary depending on the intended application (i.e., fuel properties, burner design, firing rate, combustion stoichiometry, etc.)

Figure 3:
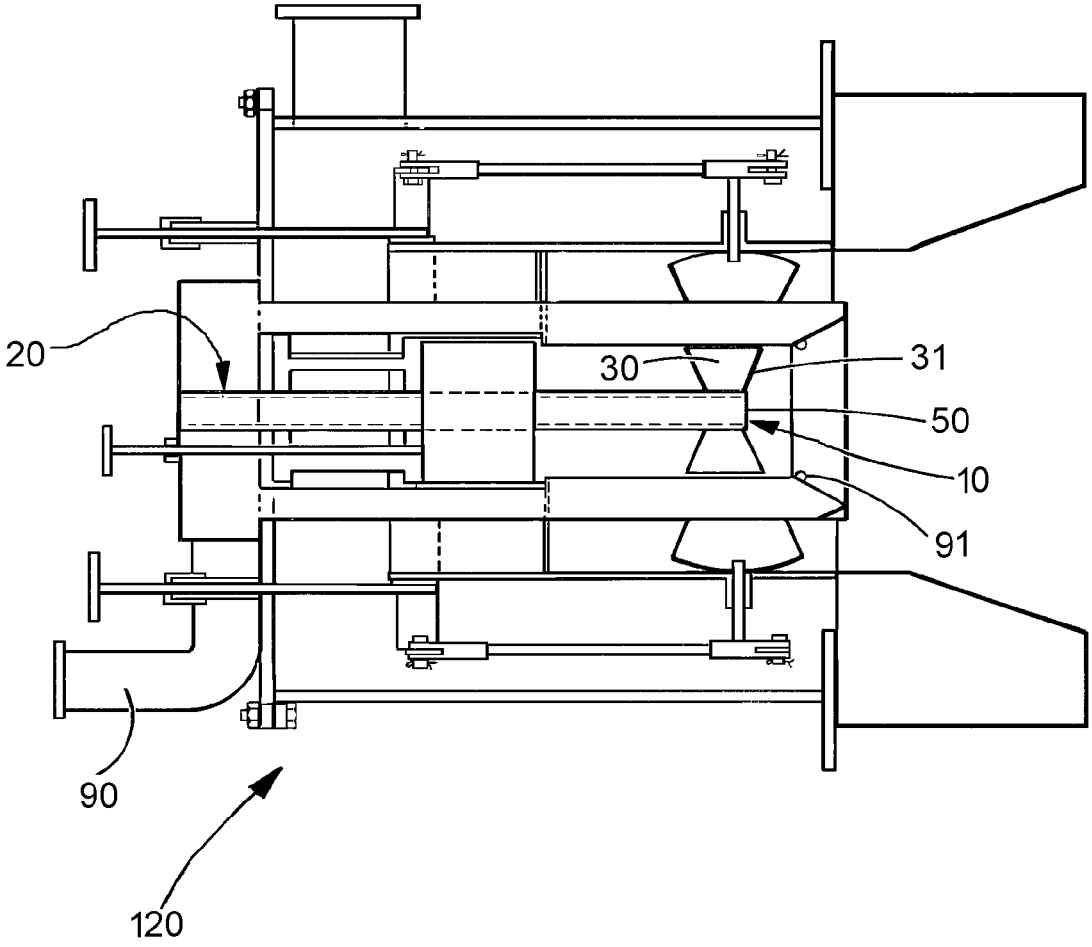
FIG. 3 is a side elevational view of an alternate embodiment of the swirler used with natural gas/fuel oil-fired burners.

In FIG. 3, the swirler 10 is used in a duel fuel burner 120. A gas supply pipe 90 transports natural gas to radial gas spuds 91 located at the throat of the burner adjacent to swirl blades 30. Fuel oil and atomizing substance travel separately through guide pipe 20 to trailing edges 31 in blades 30. The furnace end 50 of the guide pipe 20 is positioned near the radial gas spuds 91 and adjacent the furnace. Natural gas co-firing reduces $NO_x$ formation and unburned carbon emissions, and it also improves flame stability at minimum firing rates. Other benefits include lower $SO_2$ and $CO_2$ emissions from the furnace.

Figure 4:
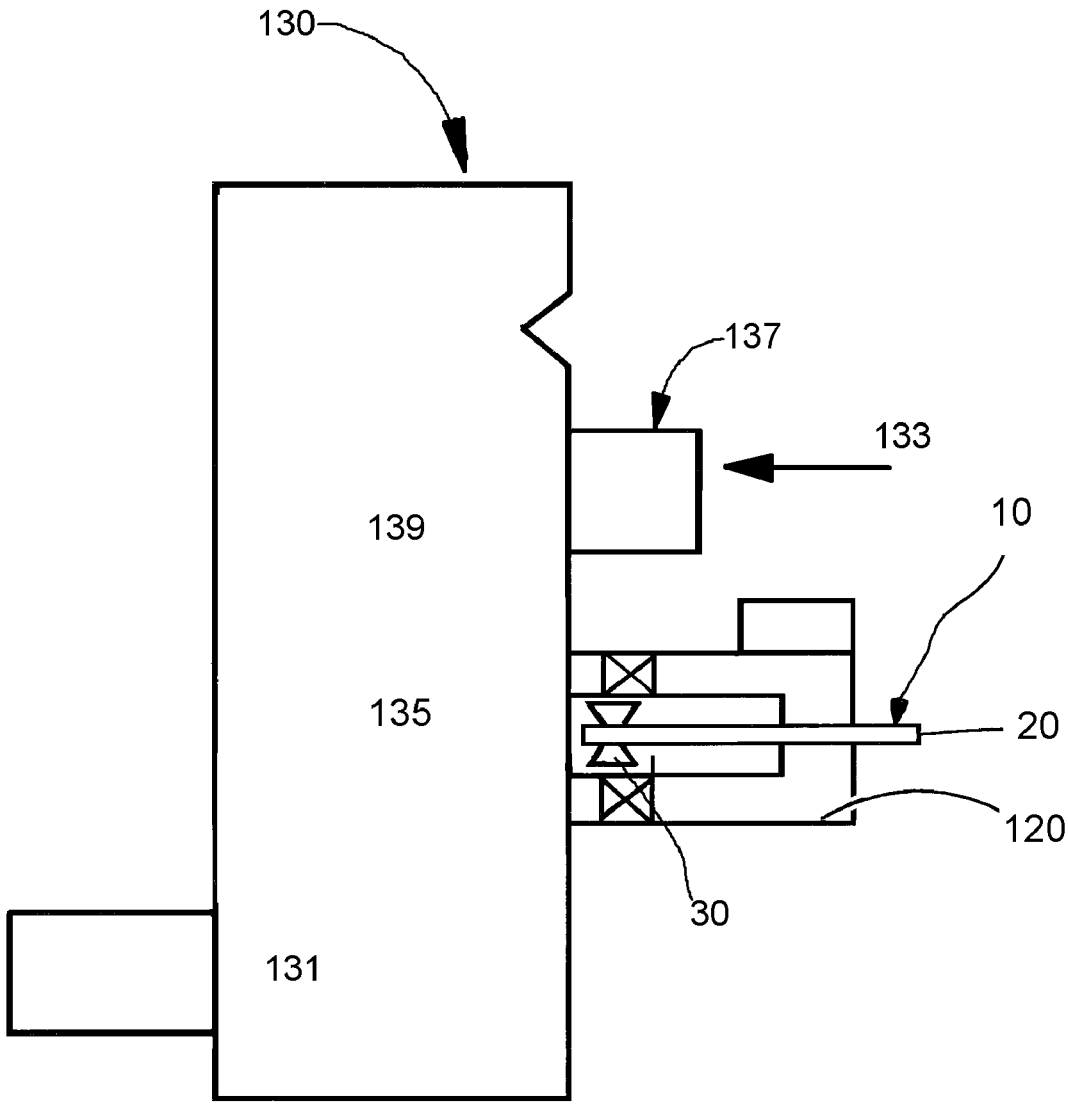
FIG. 4 is a side elevational view of a pulverized coal burner using the swirler of the invention in the reburn zone.

In FIG. 4, the swirler 10 is used in a coal-fired boiler 130 for fuel oil reburning with oxygen above the combustion zone 131. Overfire air 133 enters the burnout zone 139 via air ports 137 to complete the combustion. The swirler is installed at the throat opening of the reburn zone 135 of a boiler 130. Oxygen is transported through the annular space (not shown in FIG. 4) of guide pipe 10 to tunnels (not shown in FIG. 4) of swirler blades 30. Oxygen exits the opening 35 (not shown in FIG. 4) at the trailing edge of the swirler blades 30.

Fuel oil travels through the inner concentric fuel pipe of guide pipe 10 and tunnels of swirl blades 35 and exits openings 35.

In the case of difficult to burn anthracitic and low-volatile coals, oxygen can be injected through the swirl blades 30 to enhance the ignition and flame stability over a wide range of loads. A small amount of oxygen can be injected through the guide pipe 20 to openings 35 in swirl blades 30 to raise the elemental oxygen concentration to about 25-35% by volume. Typically, oxygen concentration in the combustion air is only about 21% by volume. The higher oxygen concentration improves both the combustion reactions and fuel ignition and flame stability.

Different configurations and orientations of the tunnels 41, 42 are possible which can transport a gaseous substance to the openings 35 in a manner consistent with this invention. The size, shape, number and orientation of the openings 35 can also be modified to further improve the $NO_x$ formation reduction experienced in an adjacent furnace provided by the swirler 10 of the invention.

With this invention, openings 35 are spread farther away from the centerline and positioned directly on the trailing edges of swirl blades 30 for better mixing. The swirling discharge pattern of the spray improves combustion of fuel droplets and shortens the frame length. Thus, it is possible to achieve short-flame, low $NO_x$, and high-efficiency combustion via the installation of the tunneled multi-blade swirler 10 for liquid fuel combustion. Liquid fuel atomization by oxygen in this device increases the local flame temperature via reducing the diluent effect of nitrogen, atomizing steam, and other inert gases. Higher flame temperatures in a reducing environment enhance fuel pyrolysis and generation of $NO_x$ reducing precursors (i.e., hydrocarbon radicals, and cyanic and amine compounds), as well as better carbon and soot burnout. The invention can become an integral part of an oxy-fuel burner.

In an alternative embodiment, the liquid fuel can flow through the annular space 27 while the atomizing medium flows through the inner pipe 22.

While a specific embodiment of the invention has been shown and described in detail to illustrate the application of the principles of the invention, it will be understood that the invention may be embodied otherwise without departing from such principles.

I claim:

1. A swirler for a furnace or boiler burner, the swirler comprising:

an elongated hollow guide pipe having a furnace end, comprising a fuel pipe concentric with and inserted through the elongated hollow guide pipe forming an annular space therebetween;

a plurality of swirl blades mounted on the guide pipe adjacent to the furnace end and each swirl blade having a trailing blade edge nearest the furnace end;

at least one opening in each of the trailing blade edges;

at least one primary tunnel in each swirl blade connecting each opening to the fuel pipe; and tunnel means for providing a liquid substance through the swirler to each of a plurality of openings in the swirl blades, wherein the tunnel means comprises at least one secondary tunnel in each swirl blade connecting each opening to the annular space.

2. A swirler according to claim 1, further comprising at least one channel in the swirl blade, the channel having an inlet and an outlet, the primary tunnel and secondary tunnel merge at the inlet, the outlet being formed at one of the plurality of openings.

3. A fuel fired burner for a furnace or boiler, the burner comprising:

a burner barrel having a supply end and a furnace throat opening;

a swirler oriented concentric within the burner barrel, the swirler having a plurality of swirl blades at a swirler furnace end; and tunnel means for providing an atomizing medium and fuel through the swirler to each of a plurality o openings in the swirl blades, wherein the plurality of openings are located in a trailing edge of each swirl blade, and the tunnel means comprises an elongate hollow guide pipe, a fuel pipe concentric with and inserted through the elongated hollow guide pipe forming an annular space therebetween, at least one primary tunnel through each swirl blade connecting the fuel pipe to each of the plurality of openings and at least one secondary tunnel through each swirl blade connecting the annular space to each of the plurality of openings.

4. A burner according to claim 3 further comprising at least one channel in the swirl blade, the channel having an inlet and an outlet, the primary tunnel and secondary tunnel merge at the inlet, the outlet being formed at one of the plurality of openings.

5. A burner according to claim 3, wherein the atomizing medium comprises oxygen, natural gas, or compressed air.

6. A fuel fired burner for a furnace or boiler, the burner comprising:

a burner barrel having a supply end and a furnace throat opening;

a swirler oriented concentric within the burner barrel, the swirler having a plurality of swirl blades at a swirler furnace end; and tunnel means for providing an atomizing medium and fuel through the swirler to each of a plurality of openings in the swirl blades, wherein the plurality of openings are located in a trailing edge of each swirl blade, and the tunnel means comprises an elongated hollow fuel pipe, a guide pipe concentric with and inserted through the elongated hollow fuel pipe forming an annular space therebetween, at least one primary tunnel through each swirl blade connecting the elongated hollow fuel pipe to each of the plurality of openings and at least one secondary tunnel through each swirl blade connecting the annular space to each of the plurality of openings.

7. A burner according to claim 6, wherein the atomizing medium comprises oxygen, natural gas, or compressed air.

* * * * *